US009608335B2

(12) United States Patent
Graceffo et al.

(10) Patent No.: US 9,608,335 B2
(45) Date of Patent: Mar. 28, 2017

(54) CONTINUOUS PHASE DELAY ANTENNA

(71) Applicant: RAYTHEON COMPANY, Waltham, MA (US)

(72) Inventors: Gary M. Graceffo, Burke, VA (US); Andrew M. Kowalevicz, Arlington, VA (US)

(73) Assignee: RAYTHEON COMPANY, Waltham, MA (US)

( * ) Notice: Subject to any disclaimer, the term of this patent is extended or adjusted under 35 U.S.C. 154(b) by 75 days.

(21) Appl. No.: 14/590,260

(22) Filed: Jan. 6, 2015

(65) Prior Publication Data

US 2015/0194735 A1 Jul. 9, 2015

Related U.S. Application Data

(60) Provisional application No. 61/925,378, filed on Jan. 9, 2014.

(51) Int. Cl.
*H01Q 19/10* (2006.01)
*H01Q 19/13* (2006.01)
*H01Q 21/28* (2006.01)

(52) U.S. Cl.
CPC ..... *H01Q 19/13* (2013.01); *H01Q 21/28* (2013.01)

(58) Field of Classification Search
CPC ..... H01Q 19/13; H01Q 21/28; H01Q 19/10; H01Q 15/16; H01Q 19/12; H01Q 15/14; H01Q 1/288; G02B 19/0023
USPC ..... 343/914, 916, 836, 840
See application file for complete search history.

(56) References Cited

U.S. PATENT DOCUMENTS 4,825,223 A * 4/1989 Moore ..... H01Q 1/40 343/840
5,606,334 A * 2/1997 Amarillas ..... H01Q 19/065 343/753
7,084,836 B2 * 8/2006 Espenscheid ..... H01Q 15/14 343/840
2005/0013616 A1 * 1/2005 Yen ..... H04B 10/1123 398/130
2010/0135203 A1 * 6/2010 Maru ..... H04B 7/04 370/328
2016/0028163 A1 * 1/2016 Li ..... H01Q 21/00 343/836

* cited by examiner

*Primary Examiner* — Dameon E Levi
*Assistant Examiner* — David Lotter
(74) *Attorney, Agent, or Firm* — Daly, Crowley Mofford & Durkee, LLP

(57) ABSTRACT

Antennas and other transducers for use in transmitting and receiving twisted waves are disclosed. A reflector includes numerous parabolic segments having focal lengths that decrease monotonically with azimuth angle. A feed is used that is located at a focal length associated with one of the segments. Thus, each segment has a phase delay that is related to a difference between the primary focal length and the focal length of the segment. This variation of phase delay with azimuth allows twisted waves to be transmitted and received.

7 Claims, 8 Drawing Sheets

CONTINUOUS PHASE DELAY ANTENNA

CROSS REFERENCE TO RELATED APPLICATION

The present application claims the benefit of U.S. Provisional Patent Application No. 61/925,378 filed on Jan. 9, 2014, which is incorporated by reference herein in its entirety.

BACKGROUND

Non-plane wave communication is a new area of communications that may provide increased bandwidth and security for over-the-air communications. As is well known, a plane wave is an electromagnetic wave having a constant phase wave front that is substantially planar. Non-plane waves (or "twisted waves"), on the other hand, are electromagnetic waves having a surface of constant phase that forms a continuous spiral in space. It is believed that such waves will permit multiple orthogonal communication channels using the same transmit frequency to operate within the same space without interfering with one another (i.e., orthogonal modes). Preliminary tests have supported these theories. It is believed that twisted wave generation is possible over large portions of the electromagnetic spectrum, including both radio frequency (RF) and light portions of the spectrum.

Techniques for generating twisted waves have thus far been relatively unsophisticated. For example, early attempts at twisted wave generation have used modified parabolic dishes for wave generation. That is, a cut was made within a conventional parabolic dish and the dish was then physically bent into a shape that was believed to support twisted wave generation. In other approaches, antenna array techniques were used to support twisted wave generation. None of the techniques developed so far were able to produce reliable, accurate, and reproducible antennas. Thus, there is a need for better antennas capable of operating with twisted waves and also better techniques for designing and fabricating such antennas.

SUMMARY

Antenna designs are provided herein that are capable of generating and receiving twisted waves. In some embodiments, an antenna is fabricated as a dish having an inherent azimuthal phase delay dependency. A conventional parabolic dish has a shape that is achieved by rotating a parabola about a central axis. This approach results in a paraboloid which possesses all the desired characteristics for generating a plane wave. In some embodiments described herein, dish antennas are provided that use a large number of parabolic segments having increasingly shorter focal points around the azimuth of the dish. A feed structure is placed at the focal point of one of the segments (e.g., a segment at 0° azimuth). In this manner, signals reflected from various segments of the dish will have a different phase delays at the feed point (during both transmit and receive operations). These azimuthally varying phase delays support the generation and reception of twisted waves.

In accordance with one aspect of the concepts, systems, circuits, and techniques described herein, a transducer comprises: a reflective dish structure comprising a large number of parabolic segments each having a different focal length, wherein the focal lengths of the segments decrease monotonically with increasing or decreasing azimuth angle; and a feed located at a focal length associated with one of the segments.

In one embodiment, the parabolic segments are infinitesimally small so that the dish structure forms a smooth continuous reflective surface.

In one embodiment, the focal lengths of the segments decrease substantially linearly with increasing or decreasing azimuth angle.

In one embodiment, the transducer is a radio frequency antenna and the feed located at the focal length associated with one of the segments includes either a feed antenna located at the focal length of one of the segments or a secondary reflector located at the focal length of one of the segments that is associated with a feed antenna.

In one embodiment, the transducer is an optical transducer and the feed located at the focal length associated with one of the segments includes at least one of: a lens, an optical fiber, a secondary optical reflector, an optical source, and an optical detector.

In one embodiment, the parabolic segments have phase delays varying between zero and one wavelength at an operational frequency of the transducer.

In accordance with another aspect of the concepts, systems, circuits, and techniques described herein, a communication system comprises: first and second dish antennas at a first location, wherein each of the first and second dish antennas includes: (a) a reflective dish structure comprising a large number of parabolic segments each having a different focal length, wherein the focal lengths of the segments decrease monotonically with increasing or decreasing azimuth angle; and (b) a feed located at a focal length of one of the segments, wherein each of the first and second dish antennas are operative in a different twisted wave mode; and third and fourth dish antennas at a second location that is different from the first location, wherein each of the third and fourth dish antennas includes: (a) a reflective dish structure comprising a large number of parabolic segments each having a different focal length, wherein the focal lengths of the segments decrease monotonically with increasing or decreasing azimuth angle; and (b) a feed located at a focal length of one of the segments, wherein the third and fourth dish antennas are operative within the same twisted wave modes as the first and second antennas, respectively, the reflective dish of the third antenna is a mirror image of the reflective dish of the first antenna, and the reflective dish of the fourth antenna is a mirror image of the reflective dish of the second antenna; wherein the first and second dish antennas are capable of concurrent wireless communication with the third and fourth dish antennas, respectively, in the same frequency band with little or no crosstalk.

In one embodiment, the system further comprises at least one additional dish antenna at the first location and at least one additional dish antenna at the second location that are operative within different twisted wave modes than the first, second, third, and fourth antennas.

In one embodiment, the system further comprises a first wireless transceiver coupled to the first dish antenna; a second wireless transceiver coupled to the second dish antenna; a third wireless transceiver coupled to the third dish antenna; and a fourth wireless transceiver coupled to the fourth dish antenna.

BRIEF DESCRIPTION OF THE DRAWINGS

The foregoing features may be more fully understood from the following description of the drawings in which.

DETAILED DESCRIPTION

Figure 1:
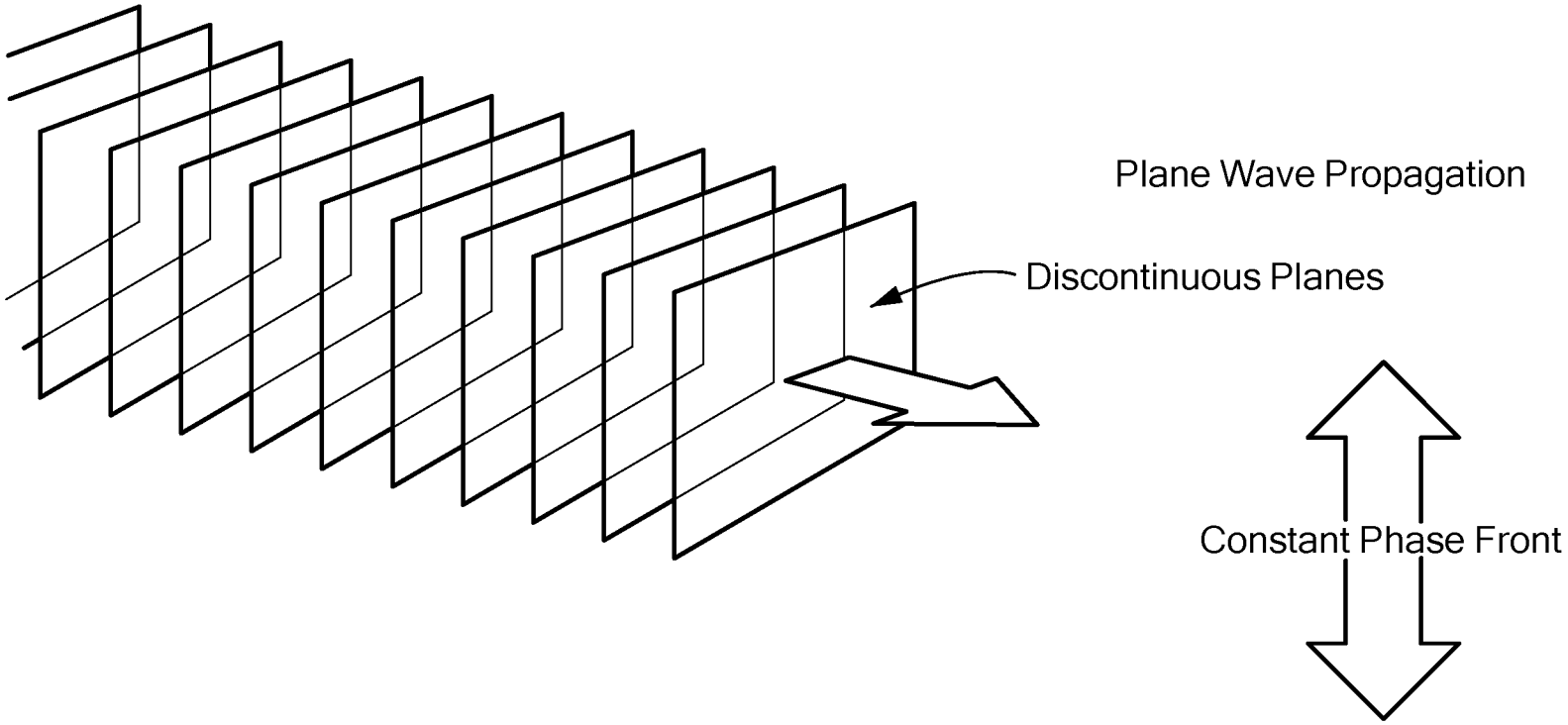
FIG. 1. is a diagram illustrating plane wave propagation.
Figure 2:
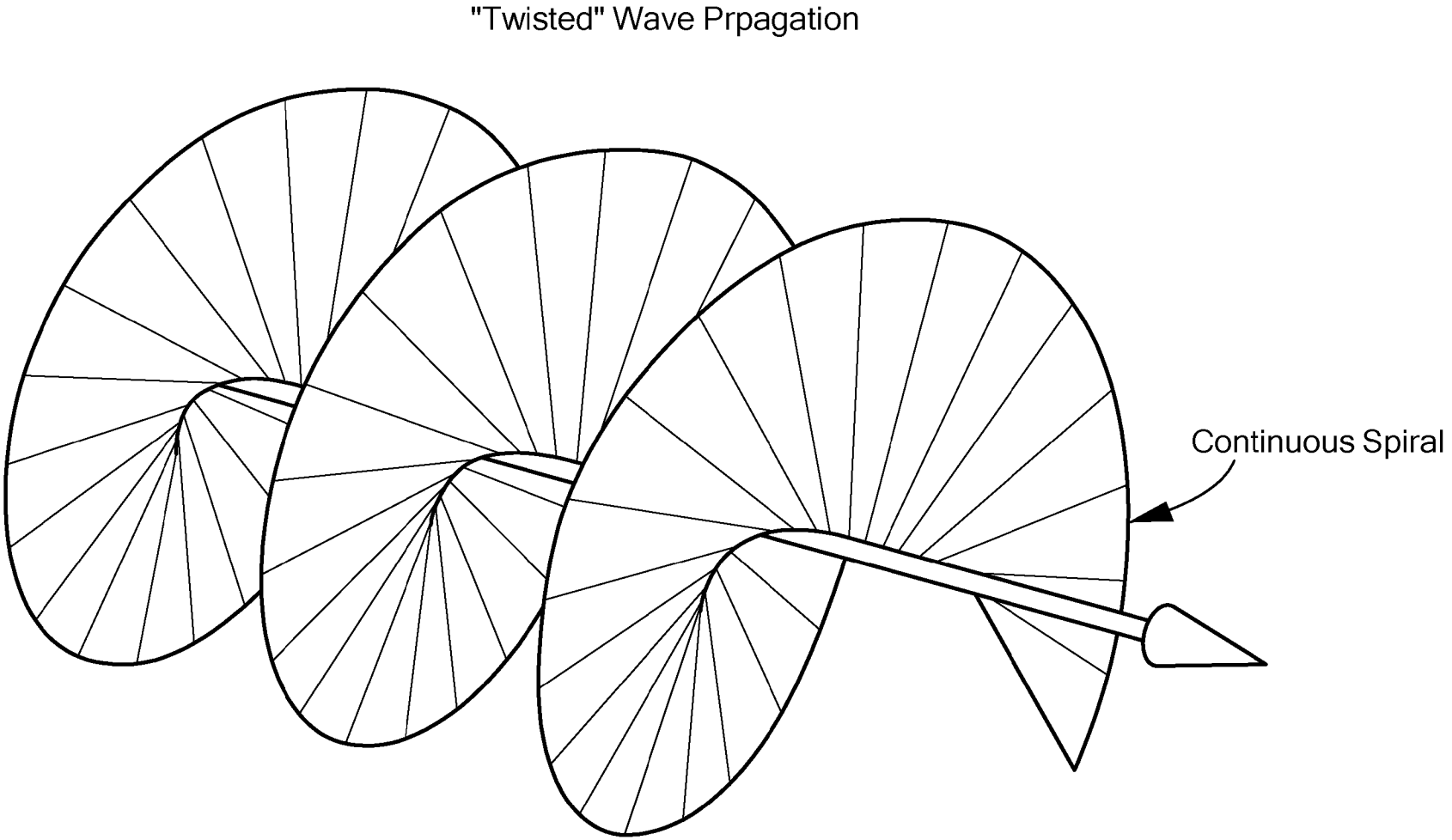
FIG. 2 is a diagram illustrating twisted wave propagation.

Techniques and structures disclosed herein relate to antennas that are capable of generating and receiving non-plane waves or twisted waves. As shown in FIG. 1, a plane wave is a propagating electromagnetic wave having surfaces of constant phase that are substantially planar. Most wireless technologies in operation today use plane waves to perform corresponding functions. Twisted waves, on the other hand, are electromagnetic waves having a surface of constant phase that forms a continuous spiral in space, as shown in FIG. 2. Twisted waves have promise for use in wireless systems because it is believed that they may increase the volume of communication that can take place within a given frequency range. More specifically, it is believed that multiple twisted waves having the same frequency may be able to propagate within a common region without interfering with one another (i.e., orthogonal communication channels) as long as one or more properties of the waves are varied. These properties may include, for example, the orbital angular momentum (OAM) of the waves and the direction of the spiral (e.g., clockwise or counterclockwise).

Figure 3:
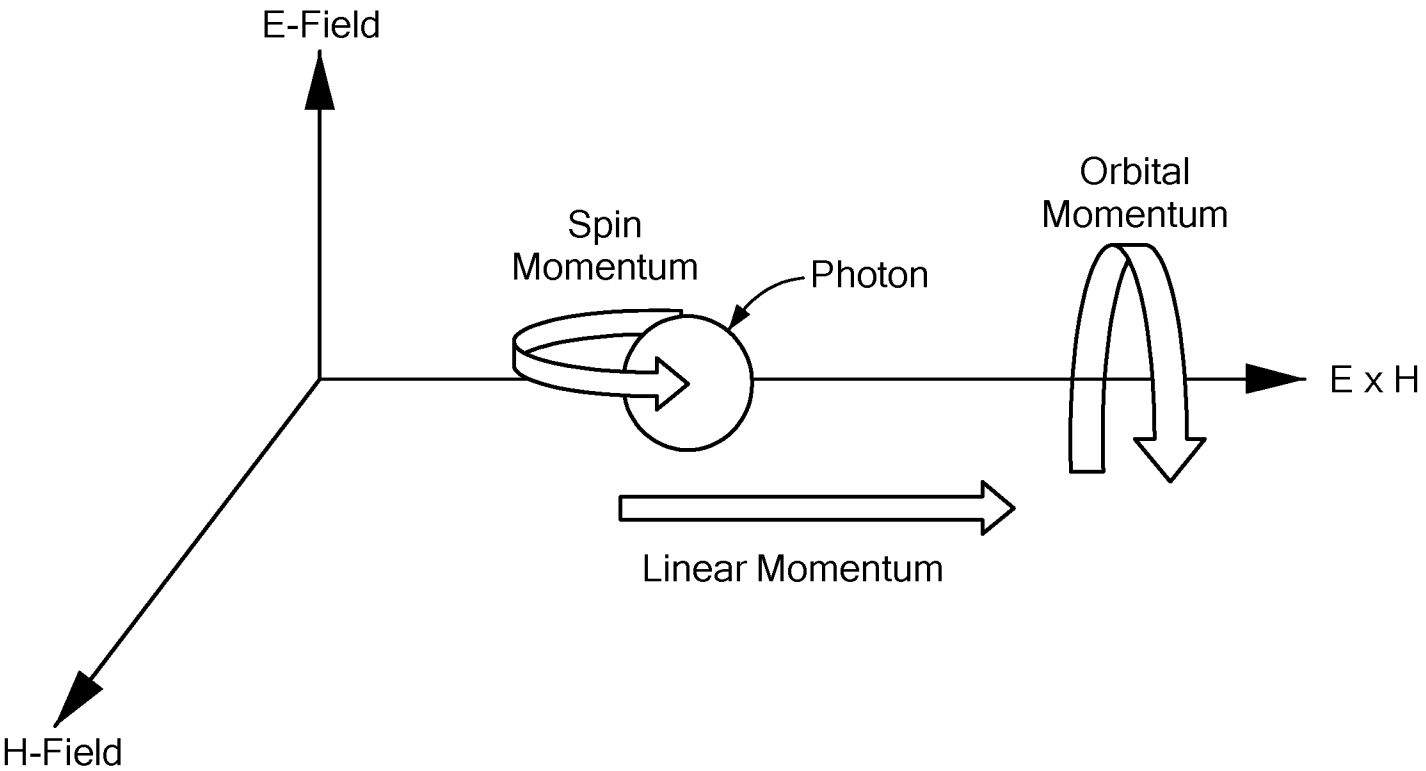
FIG. 3 is a diagram illustrating the mechanics of a photon.

Twisted waves can exist at both radio frequencies (RF) and optical frequencies. One way of better understanding twisted waves is to consider a single photon or light quantum. As shown in FIG. 3, a photon travelling in space has three momentum properties: linear momentum, spin momentum, and orbital momentum. The linear momentum of the photon generates electric and magnetic fields. The spin angular momentum determines whether the field is circularly (left or right) or linearly polarized. The orbital angular momentum (OAM) imposes an azimuthal phase dependency on the electric and magnetic fields, such that phase is no longer constant across the wave front. There are an infinite number of OAM states.

The number of intertwined helices in a twisted wave may be specified as a state or mode number, $|N|$. Twisted waves can be modeled using the Paraxial Wave Equation. One solution to this equation is the Laguerre-Gaussian equation (LGE), which has a phase term that is a function of both azimuth and N. Points of constant phase in this solution form a rotating helix of pitch equal to $|N|\times$wavelength. The rotations for various OAM states may be designated as follows: a first state (N=0) corresponds to plane waves, a second state (N=1) corresponds to one rotating spiral, a third state (N=2) corresponds to two rotating spirals, and so on. The sign of N designates the handedness of the twisted wave (right or left).

Figure 4A:
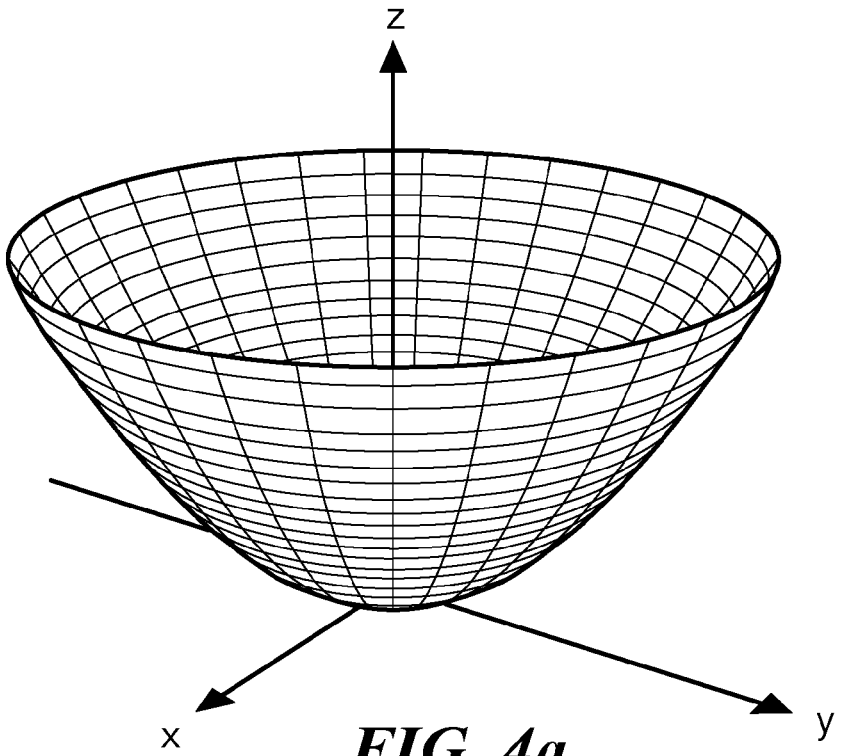
FIGS. 4*a* and 4*b* are diagrams illustrating shapes associated with a conventional parabolic dish antenna.
Figure 4B:
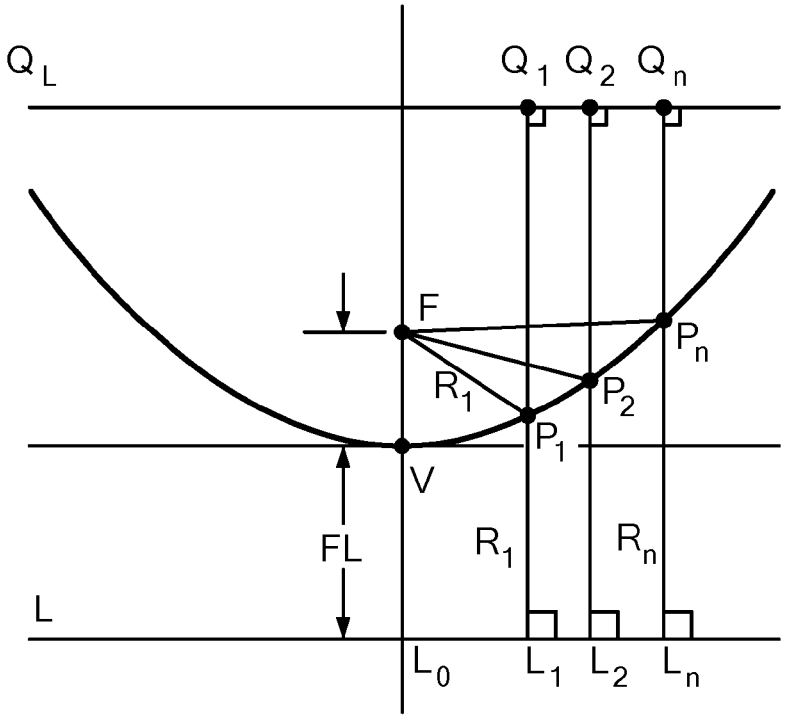

The parabolic dish is a standard reflector used in many antenna designs. The shape of a conventional parabolic dish is a paraboloid, as shown in FIG. 4*a*. A paraboloid is the shape that results by rotating a parabola about a central axis (e.g., the z-axis). A parabola is shown in FIG. 4*b*. A parabolic dish antenna typically has a feed located at a focus (F) of the paraboloid. An incoming plane wave is reflected off of the parabolic dish and toward the feed. A characteristic of the paraboloid shape is that all reflected portions of the incoming wave arrive at the feed (i.e., the focus) in phase, regardless of which portion of the dish reflected the wave portion.

In one prior attempt to fashion an antenna to handle twisted waves, a conventional parabolic disk was manually distorted. That is, a radial cut was made in the dish, and the dish was then bent to a new shape that was believed to provide the desired phase shift. As can be appreciated, this technique has many problems including, for example, that: (1) the surface is non-linear and not linear in phase, (2) the process is not repeatable so that it is difficult to generate a corresponding receive antenna, and (3) there is no control over the azimuthal gradation.

To overcome one or more of the problems with prior antennas, a new antenna design was developed that includes a dish reflector formed from a large number of differential parabola segments arranged in azimuth. Each segment in the dish has an increasingly shorter focal length than a previous segment as azimuth angle increases (or decreases) on the reflector surface. The focal length of one of the segments is used as the focal length of the antenna (i.e., the feed is located at this focal length). In one exemplary embodiment, for example, the segment located at 0° azimuth has the longest focal length and this focal length is used to position the feed. It should be appreciated, however, that that focal length of any of the segments may be used in other embodiments and the longest focal length does not need to be used.

Figure 5:
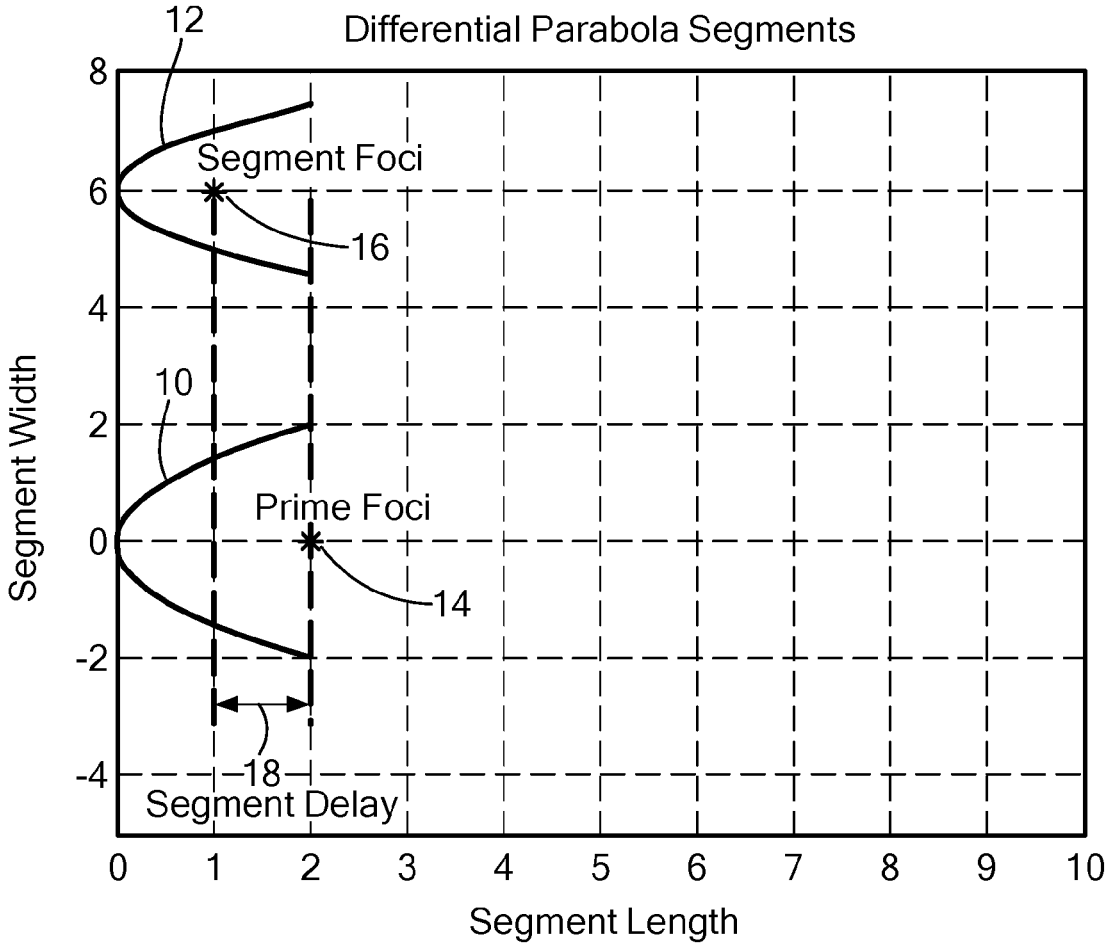
FIG. 5 is a graph illustrating an exemplary relationship between parabolic segments of a dish antenna in accordance with an embodiment.

Because each successive segment has a different focal length, each segment generates a different phase delay which is equal to the difference between the prime focus of the antenna and the individual foci of the segment. FIG. 5 is a graph illustrating this concept showing a first parabola 10 associated with a primary segment of the dish and a second parabola 12 associated with one of the other segments of the dish. As shown, the first parabola 10 has a foci 14 at which the feed of the antenna will be located. The second parabola 12 has a foci 16 that is different from the primary foci 12. The difference 18 between the foci 14 and the foci 16 defines the segment delay of the segment associated with parabola 12.

The size of the different segments (i.e., the angular spread in azimuth) can vary in different implementations. In some implementations, the segments are very narrow (e.g., infinitesimally small, etc.) so that a relatively smooth continuous surface results. Larger segments may alternatively be used. As the segments become larger, discontinuity in phase will result and if the discontinuities are large enough, a splattering of energy may occur, which could have negative results. For example, this could create a multipath situation, which is destructive to the wave and could result in less energy arriving at the foci in the proper phase, which is also destructive. Thus, there is an upper limit to the size of the segments that can be used.

Any of a variety of different fabrication techniques may be used to form a dish in accordance with the present disclosure. This may include, for example, three-dimensional (3D) printing, stamping, forging, machining, and/or others. Three-dimensional printing can include three-dimensional printing in metal or three-dimensional printing in a dielectric material (e.g., a plastic, etc.) with a subsequent lamination or plating with a conductive material (e.g., a metal) to make the dish electrically reflective.

Figure 6B:
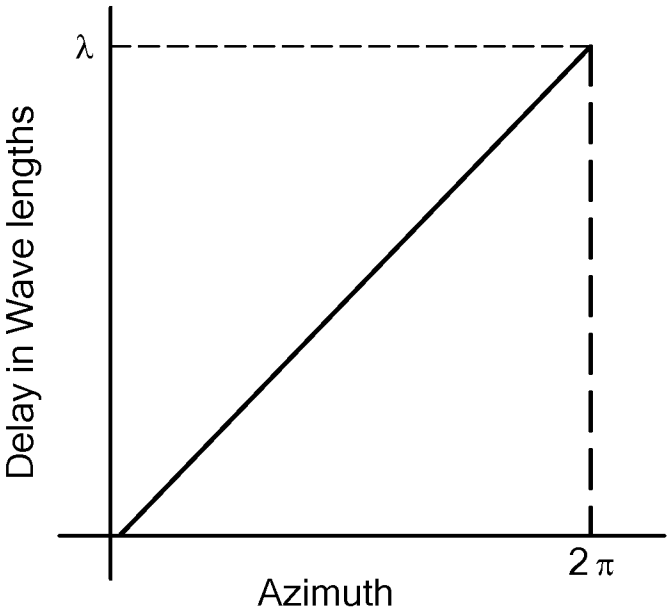
FIG. 6*b* is a plot of phase delay versus azimuth angel for the dish antenna design of FIG. 6*a;*
Figure 6A:
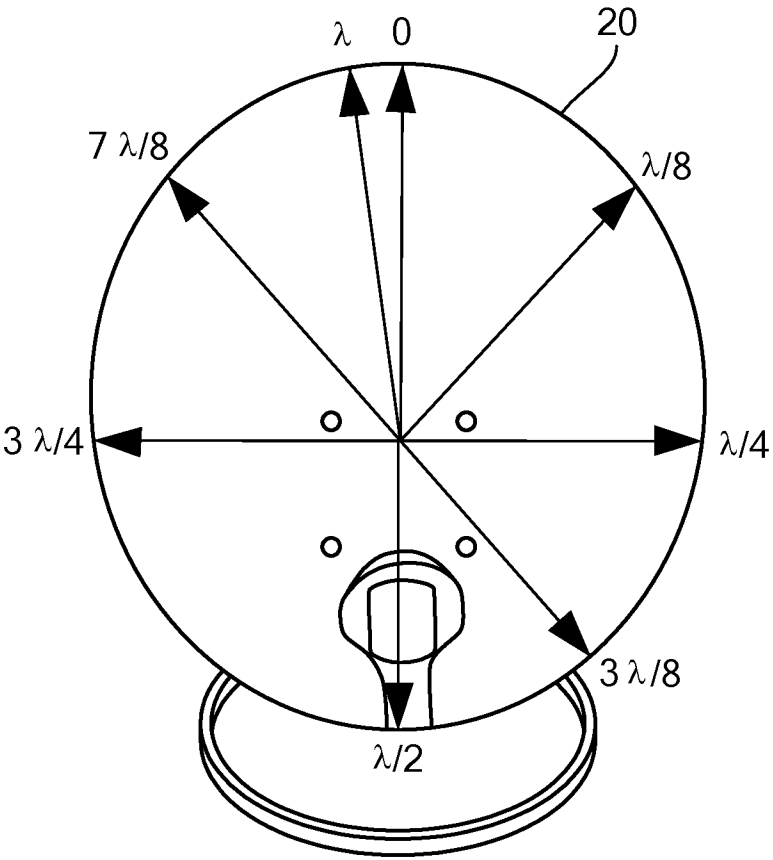
FIG. 6*a* is a front view of an exemplary dish antenna design in accordance with an embodiment.

FIG. 6*a* is a front view of an exemplary dish antenna design 20 in accordance with an embodiment. The dish antenna design 20 has a phase delay that changes continuously and linearly with azimuth angle. FIG. 6*b* is a plot of phase delay versus azimuth angel for the exemplary design. As shown, the phase delay is zero at 0° azimuth, one eighth wavelength (λ) at 45° azimuth, λ/4 at 90° azimuth, 3λ/8 at 135° azimuth, and so on. At 360° azimuth, the phase delay reaches one wavelength. It should be appreciated that the design 20 of FIGS. 6*a* and 6*b* represents one possible scheme for arranging the phase delays of the dish in accordance with an embodiment. Many other phase delay scenarios may alternatively be used.

Figure 7:
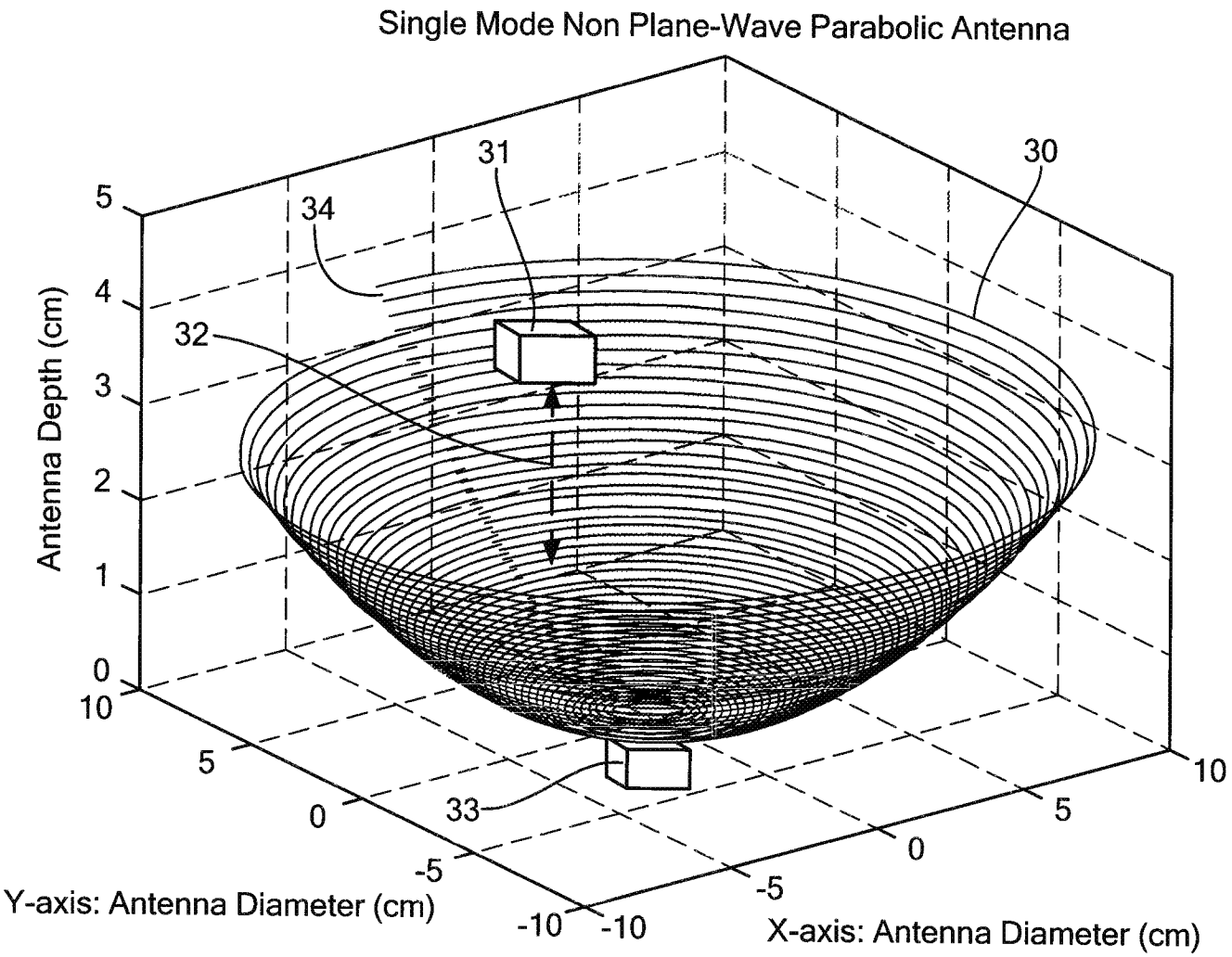
FIG. 7 is a diagram illustrating another exemplary dish reflector design in accordance with an embodiment.

FIG. 7 is a diagram illustrating another exemplary dish reflector 30 in accordance with an embodiment. As shown, the dish 30 is plotted as a function of x and y coordinates and antenna depth (z coordinate). As shown, the dish reflector has a non-symmetrical shape due to the varying focal, length associated with the segments (e.g., segments 34). The dish 30 is associated with a single twisted wave propagating mode. A mirror image dish would be required to receive signals transmitted from the dish 30. Two way wireless communication would be supported between antennas associated with the two mirror imaged dishes. To support other twisted wave modes, other dishes would be needed. However, communications between dish pairs in the various modes would be substantially orthogonal to one another, even if the antennas are proximately located and if the same frequency is being used in each mode. This enables a twisted wave mode diversity to be achieved that enables a higher volume of communications to be supported within a given portion of the electromagnetic spectrum. A twisted wave mode may be defined by, for example, the pitch of the twisted wave (which is related to the rate of change of phase delay with azimuth angle) and the direction of the twist (e.g., clockwise versus counterclockwise).

Figure 8:
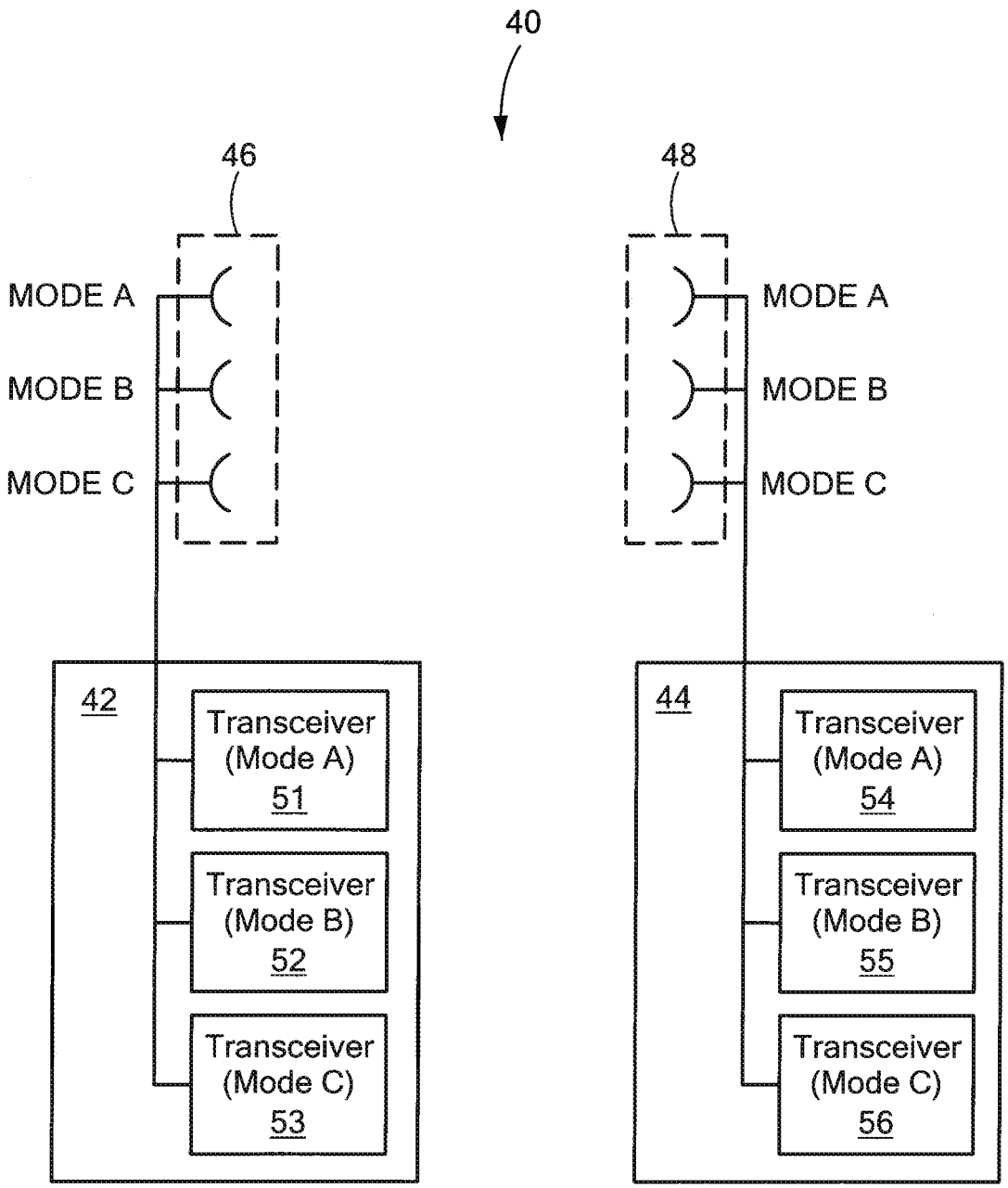
FIG. 8 is a diagram illustrating an exemplary point-to-point wireless link in accordance with an embodiment.

FIG. 8 is a diagram illustrating an exemplary point-to-point wireless link 40 that may make use of antenna designs described herein. As shown, the link 40 may be between two buildings 42, 44 within, for example, a municipality. The first building 42 includes multiple antennas 46 that are each associated with a different twisted wave mode (e.g., Mode A, Mode B, and Mode C). The second building 44 includes the same number of antennas 48 that are each associated with the same set of twisted wave modes. The antennas 48 on the second building 44, however, are mirror images of corresponding antennas 46 on the first building 42. Each building 42, 44 may include transceiver circuitry for each of the corresponding antennas (e.g., transceivers 51, 52, and 53 of building 42, and transceivers 54, 55, and 56 of building 44). Because the different antennas are operative within different modes, multiple separate links may be established between the buildings 42, 44 at the same frequency without causing significant interference between links. In this manner, a higher volume of communication can be supported between the buildings 42, 44 within a particular frequency band than would be possible using conventional dish antennas. Although illustrated in FIG. 8 with three antennas on each side of the link, it should be appreciated that any number of antennas of different modes may be used in different implementations.

In embodiments described above, the feeed (e.g., 31 of FIG. 7) of a dish antenna is located at a focal length (e.g., 32 of FIG. 7) of a primary dish segment among a large number of different dish segments (e.g., 34 of FIG. 7). It should be appreciated that block 31 could include either a feed antenna located at this focal length or a secondary reflector at this focal length that is associated with a feed antenna (e.g., 33) at a different location (such as in, for example, a Cassegrain antenna).

In the description above, various structures, techniques, and concepts are described in the context of radio frequency transmission and reception. It should be appreciated, however, that these structures, techniques, and concepts also have application in other portions of the electromagnetic spectrum. For example, reflectors having one or more of the properties described above may be used in an optical system for generating and/or receiving optical twisted waves in one or more embodiments. In such systems, reflectors having mirrored or highly polished surfaces may be used to support optical reflection. An optical feed may be used at the focal length of a primary segment of the reflector. The optical feed may include, for example, a lens, an optical fiber, a secondary optical reflector, an optical source, an optical detector, and/or other structures.

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A transducer comprising:

a reflective dish structure comprising a plurality of parabolic segments, each parabolic segment having a different focal length, wherein the focal lengths of the parabolic segments decrease monotonically with increasing or decreasing azimuth angle; and a feed located at a distance above the reflective dish structure, the distance equal to a focal length associated with a selected one of the parabolic segments, wherein the parabolic segments are sized to provide the dish structure having a continuous reflective surface.

2. The transducer of claim 1, wherein:

the focal lengths of the segments decrease substantially linearly with increasing or decreasing azimuth angle.

3. The transducer of claim 1, wherein:

the transducer is a radio frequency antenna and the feed comprises one of: (i) a feed antenna located at a distance above the reflective dish structure, the distance equal to the focal length associated with a selected one of the parabolic segments, and (ii) a secondary reflector located at a distance above the reflective dish structure, the distance equal to the focal length associated with a selected one of the parabolic segments, the selected one of the parabolic segments associated with a feed antenna at a different location.

4. The transducer of claim 1, wherein:

the parabolic segments have phase delays varying between zero and one wavelength at an operational frequency of the transducer.

5. A communication system comprising:

first and second dish antennas at a first location, wherein each of the first and second dish antennas includes: (a) a reflective dish structure comprising a plurality of parabolic segments, each parabolic segment having a different focal length, wherein the focal lengths of the parabolic segments decrease monotonically with increasing or decreasing azimuth angle, wherein the parabolic segments are sized to provide the dish structure having a continuous reflective surface; and (b) a feed located at a distance above the reflective dish structure, the distance equal to a focal length associated with a selected one of the parabolic segments, wherein each of the first and second dish antennas are operative in a different twisted wave mode; and third and fourth dish antennas at a second location that is different from the first location, wherein each of the third and fourth dish antennas includes: (a) a reflective dish structure comprising a plurality of parabolic segments, each parabolic segment having a different focal length, wherein the focal lengths of the parabolic segments decrease monotonically with increasing or decreasing azimuth angle, wherein the parabolic segments are sized to provide the dish structure having a continuous reflective surface; and (b) a feed located at a distance above the reflective dish structure, the distance equal to a focal length associated with a selected one of the parabolic segments, wherein the third and fourth dish antennas are operative within the same twisted wave modes as the first and second antennas, respectively, wherein a shape of the reflective dish structure of the third antenna is a mirror image of a shape of the reflective dish structure of the first antenna, and wherein a shape of the reflective dish structure of the fourth antenna is a mirror image of a shape of the reflective dish structure of the second antenna;

wherein the first and second dish antennas are capable of concurrent wireless communication with the third and fourth dish antennas, respectively, in the same frequency band without crosstalk.

6. The system of claim 5, further comprising:

at least one additional dish antenna at the first location and at least one additional dish antenna at the second location that are operative within different twisted wave modes than the first, second, third, and fourth antennas.

7. The system of claim 5, further comprising:

a first wireless transceiver coupled to the first dish antenna;

a second wireless transceiver coupled to the second dish antenna;

a third wireless transceiver coupled to the third dish antenna; and a fourth wireless transceiver coupled to the fourth dish antenna.

* * * * *